US006688428B2

(12) United States Patent
Carroll, Jr.

(10) Patent No.: US 6,688,428 B2
(45) Date of Patent: Feb. 10, 2004

(54) UNIVERSAL LADDER LOCK AND METHOD

(76) Inventor: Elmer C. Carroll, Jr., 10047 Inwood, Houston, TX (US) 77042

( * ) Notice: Subject to any disclaimer, the term of this patent is extended or adjusted under 35 U.S.C. 154(b) by 85 days.

(21) Appl. No.: 09/932,383

(22) Filed: Aug. 17, 2001

(65) Prior Publication Data

US 2003/0034206 A1 Feb. 20, 2003

(51) Int. Cl.[7] ..... E06C 5/00
(52) U.S. Cl. ..... 182/127; 182/92; 224/310
(58) Field of Search ..... 182/92, 127; 224/310; 211/13; 403/109.1–109.9

(56) References Cited

U.S. PATENT DOCUMENTS

| | | | | | |
|---|---|---|---|---|---|
| 4,008,838 | A | * | 2/1977 | Correll | 224/42 |
| 4,262,834 | A | * | 4/1981 | Nutt | 224/324 |
| 4,390,117 | A | * | 6/1983 | Fagan | 224/310 |
| 4,826,387 | A | * | 5/1989 | Audet | 414/462 |
| 4,887,750 | A | * | 12/1989 | Dainty | 224/42.11 |
| 4,959,981 | A | * | 10/1990 | Davidson | 70/238 |
| 5,009,350 | A | * | 4/1991 | Schill et al. | 224/324 |
| 5,058,791 | A | * | 10/1991 | Henriquez et al. | 224/310 |
| 5,154,258 | A | * | 10/1992 | Krukow | 182/127 |
| 5,398,778 | A | * | 3/1995 | Sexton | 182/127 |
| 5,850,891 | A | * | 12/1998 | Olms et al. | 182/127 |
| 5,884,824 | A | * | 3/1999 | Spring, Jr. | 224/310 |
| 6,099,231 | A | * | 8/2000 | Levi | 414/462 |
| 6,135,686 | A | * | 10/2000 | Chasen | 410/120 |
| 6,257,534 | B1 | * | 7/2001 | Finley | 248/201 |
| 6,290,113 | B1 | * | 9/2001 | Plyler | 224/315 |
| 6,315,181 | B1 | * | 11/2001 | Gradley et al. | 224/310 |
| 6,427,889 | B1 | * | 8/2002 | Levi | 224/315 |
| 6,428,263 | B1 | * | 8/2002 | Schellens | 414/462 |
| 2002/0088187 | A1 | * | 7/2002 | Howard et al. | 52/162 |

FOREIGN PATENT DOCUMENTS

| | | | | |
|---|---|---|---|---|
| GB | 2063344 | * | 6/1981 | 182/127 X |

* cited by examiner

*Primary Examiner*—Bruce A. Lev
(74) *Attorney, Agent, or Firm*—The Matthews Firm; William E Johnson, Jr.

(57) ABSTRACT

A universal ladder lock and method for locking a ladder to a vehicular rack utilizes a mounting frame that may be secured to existing vehicular racks. Affixed to the mounting frame is a lock housing which slidably and rotatably supports an elongate lock arm. A hook is provided on one end of the elongate lock arm for hooking around a portion of one or more ladders. One or more stop elements are secured to the elongate lock arm for limiting longitudinal movement of the elongate lock arm. The stop housing provides one or more lock member supports which may be utilized to receive a locking pin, or a padlock. The locking pin or padlock prevents movement of the stop element affixing the elongate lock arm in a position with the hook around the ladder to thereby lock the ladder with respect to the vehicular rack.

19 Claims, 3 Drawing Sheets

UNIVERSAL LADDER LOCK AND METHOD

BACKGROUND OF THE INVENTION

1. Field of the Invention

The present invention relates generally to vehicular rack locking mechanisms and, more particularly, is highly suitable for providing a universal vehicular ladder lock to secure one or more ladders onto a vehicular support rack.

2. Description of the Background

It is well know in the art to transport ladders on vehicles such as vans, panel trucks, and pickup trucks. It is also well known that there are many different types of vehicular racks utilized for this purpose. However, once the ladder is positioned on the rack, the ladder is often free to move about thereby producing objectionable noises, causing abrasive wear on the ladder and the rack, and being readily susceptible to theft. In more extreme cases, the ladder may even become detached from the rack, and fall to the ground such as during travel over rough roads. Even though there is a wide range of racks that are utilized for carrying ladders and/or other items, it would be highly desirable to provide a ladder lock mechanism that would operate with virtually any already existing vehicular rack system and thereby inexpensively correct the defects discussed above of the many different prior art rack systems currently being utilized.

Patents which may be related to the above issues include the following:

U.S. Pat. No. 5,058,791, issued Oct. 22, 1991, to Henriquez et al. discloses a vehicular ladder rack comprising a stationary mounting frame including a pair of transverse frame members affixed to the roof of a vehicle, a positioning assembly including a pair of positioning members affixed to opposite end portions of an elongated longitudinal positioning element rotatable between a first and second position coupled to the pair of transverse frame members and a ladder support frame including a pair of ladder support members movable between a first and second position to support a ladder thereon operatively coupled between the pair of transverse frame members and the corresponding positioning member such that a ladder is supported over the roof of the vehicle for storage and transportation when the elongated longitudinal positioning element and ladder support frame are in the first position and the ladder support frame is moved from the first to the second position when the elongated longitudinal positioning element is rotated from the first to the second position to move the ladder support frame from the first to the second position adjacent the side of the vehicle to permit a ladder to be mounted thereon or removed therefrom.

U.S. Pat. No. 4,887,750, issued Dec. 19, 1989, to R. K. Dainty, discloses a rack arrangement for supporting a load, for example above the roof of a vehicle body, and comprises a pair of substantially parallel elongate guide members each having a lower upwardly extending portion and an upper load supporting portion. A load carrier member is lockably connected to the guide members and is manually slidable from a lowered position upwardly along the lower guide member portions 3*a* onto the supporting portions to a load storage position. Means are provided for releasably retaining the carrier member in the load storage position, for example a cup-like recess, which locates the base of a handle for the carrier member.

U.S. Pat. No. 4,826,387, issued May 2, 1989, to M. Audet, teaches that heavy materials such as ladders, pipes and the like are often carried on a roof rack secured to the roof of service trucks, vans and the like and of course are difficult to place on the rack and remove therefrom. The present device includes a carrier which can be extended and retracted relative to the rack and is hinged so that it drops down adjacent the sides of the truck when extended, to facilitate loading and unloading of the material carried by the rack. When hinged upwardly to approximately the horizontal position, it may be pushed towards the longitudinal center of the roof so that it telescopes inwardly thus supporting the material upon the rack. Automatic latches are included to detachably lock the carrier in the retracted position and snubbers are provided to space the carrier from the side walls of the van or truck when in the extended, substantially vertical position.

U.S. Pat. No. 4,262,834, issued Apr. 21, 1981, to W. H. Nutt, teaches a vehicle roof rack which comprises a rack frame and a releasable clamping device for releasably clamping a ladder thereto. The clamping device includes a clamp arm which is pivoted to a rigid support and operated by a crank mechanism by moving across a dead-center position to clamp the ladder in place. Clamping members are resiliently supported on the clamp arm to engage the ladder and exert a clamping pressure on it.

U.S. Pat. No. 4,390,117 discloses a ladder rack for a vehicle roof which comprises a sub-frame having clamps for releasable attachment to the roof of a vehicle. The sub-frame carries front and rear ladder support assemblies each comprising transverse rollers for engaging the stringers of a ladder spanning the two assemblies. Each support assembly further comprises a respective ladder-retaining member manually pivotal about a transverse axis from a lowered inoperative position to a raised rung-engaging position. The front and rear ladder-retaining members are operated by a handle or handles pivoted at one side of the rear support assembly, either independently or simultaneously. Furthermore, the rollers of the front support assembly are mounted to be manually raised and lowered. A ladder spanning the assemblies may be brought into a downwardly and rearwardly inclined orientation for off-loading from the rear of the vehicle. The manual operation of the front rollers is independent of the manual operation of at least the rear ladder-retaining member, so that a ladder may be brought to the inclined position in preparation for unloading while still being retained on the rack by the rear ladder-retaining member.

The above-listed patents do not disclose means that solve the problems discussed hereinbefore. Consequently, there remains a need for a relatively inexpensive means for locking ladders to racks of many different types which may be utilized to provide safer and more reliable transportation of ladders on vehicles on already existing vehicular racks as well as newly designed racks. Those skilled in the art have long sought and will appreciate the present invention which provides solutions to these and other problems.

SUMMARY OF THE INVENTION

The present invention was designed to provide a universal ladder lock for use on a wide variety of vehicular racks.

Yet another object of the present invention is to provide an improved ladder locking mechanism.

Yet another object of the present invention is to provide a rugged and easily operable ladder lock which can receive a padlock or locking pin for securing a ladder with respect to a vehicular rack.

These and other objects, features, and advantages of the present invention will become apparent from the drawings, the descriptions given herein, and the appended claims.

Therefore, the present invention provides a ladder lock for locking a ladder to a vehicular rack comprising elements such as, for instance, a mounting frame securable with respect to the vehicular rack and a lock housing secured to the mounting frame whereby the lock housing supports an upper guide and a lower guide. Other elements may include an elongate lock arm slidably mounted within the upper guide and the lower guide for sliding movement between a locked position and an unlocked position along an axis of at least a portion of the elongate lock arm and for rotation of the elongate lock arm about the axis. At least one lock element may be mounted to the elongate lock arm for movement therewith within the lock housing. The lock element may be sized for stopping engagement with the upper guide thereby preventing/limiting the sliding movement of the elongate lock arm in one direction. As well, the lock element may be sized for stopping engagement with the lower guide thereby preventing/limiting the sliding movement of the elongate lock arm in an opposite direction. Furthermore, one or more lock receptacles may be formed on the lock housing. The lock receptacles may be operable for receiving a locking member such as a padlock or locking pin to thereby limit the sliding movement of the at least one lock element and the elongate lock arm to lock the ladder to the vehicular rack.

Other elements may include, for instance, a hook at one end of the elongate lock arm wherein the hook is U-shaped and sized to fit over the ladder. A handle may be provided at an opposite end of the elongate lock arm from the hook wherein the handle may further comprise a nonmetallic or relatively soft material. In one embodiment, the elongate lock arm may further comprise a rod with a circular cross-section. A brace may be provided between the mounting frame and the lock housing such that the lock housing is mounted at an angle with respect to the mounting frame. In one embodiment, the brace is adjustable for adjusting the angle between the mounting frame and the lock housing.

In other words, a ladder lock may comprise elements such as a mounting frame, an upper guide and a lower guide secured with respect to the mounting frame, a lock arm slidably mounted within the upper guide and the lower guide, at least one lock element mounted to the elongate lock arm for movement therewith, and one or more receptacles affixed with respect to the mounting frame which may be operable for receiving a lock member to thereby limit the sliding movement of the lock arm to thereby lock the ladder to the vehicular rack.

A method for making a ladder lock is provided which comprises one or more steps such as, for instance, providing a mounting for securing the ladder lock with respect to the vehicular rack, slidably mounting a rod section within a first rod guide and a second rod guide such that the rod section is longitudinally and rotatably moveable within the first rod guide and the second rod guide, providing a hook at one end of the rod section for looping around a portion of a ladder, securing at least one stop member to the rod section to limit travel of the stop member between the first rod guide and the second rod guide, and providing one or more lock member holders adjacent the rod section such that when a lock member is positioned within the lock member holder that the stop member prevents longitudinal movement of the rod section to thereby lock the ladder to the vehicular rack.

Other steps may include affixing a tubular housing to the mounting such that the rod section is moveable within the tubular housing, affixing the first rod guide and the second rod to the tubular housing, forming the one or more lock member holders within the tubular housing fashioning a hook on one end of the rod section, and/or fashioning a handle on one end of the rod section.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PREFERRED EMBODIMENTS

Figure 3:
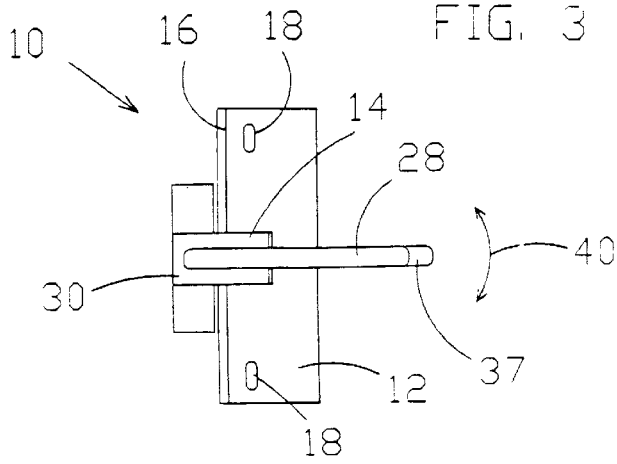
FIG. 3 is a top view of the universal ladder lock mechanism of FIG. 1 in accord with the present invention.
Figure 1:
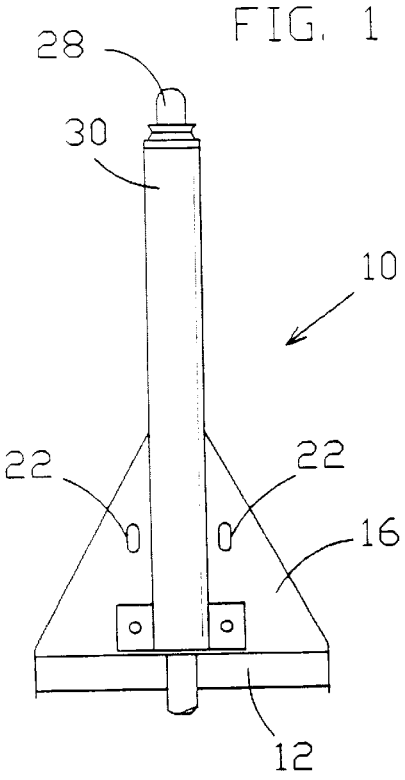
FIG. 1 is a front elevational view of a universal ladder lock apparatus in accord with the present invention.
Figure 2:
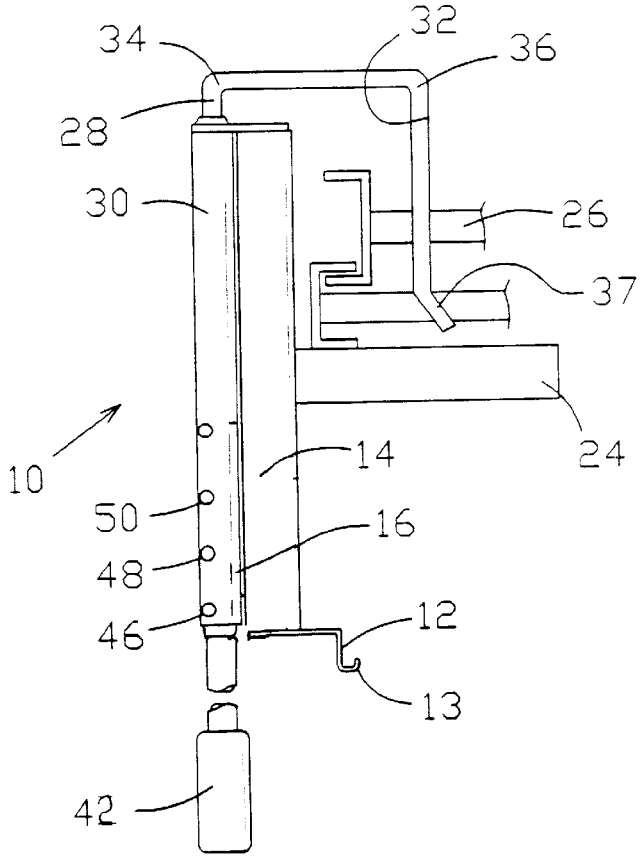
FIG. 2 is a side elevational view of the universal ladder lock apparatus of FIG. 1 in accord with the present invention.

Referring now to the drawings, and more particularly to FIG. 1 through FIG. 3, there is shown universal ladder lock 10 in accord with the present invention. Universal ladder lock 10 may be built into a vehicular rack or may be a convenient add-on thereto. Mounting plate 12, along with strut 14 and brace 16, may be adapted to any type of suitable mounting. In a preferred embodiment, strut 14 is preferably securely attached to mounting bracket 12 by means of a support brace, such as triangular support brace 16.

Figure 6:
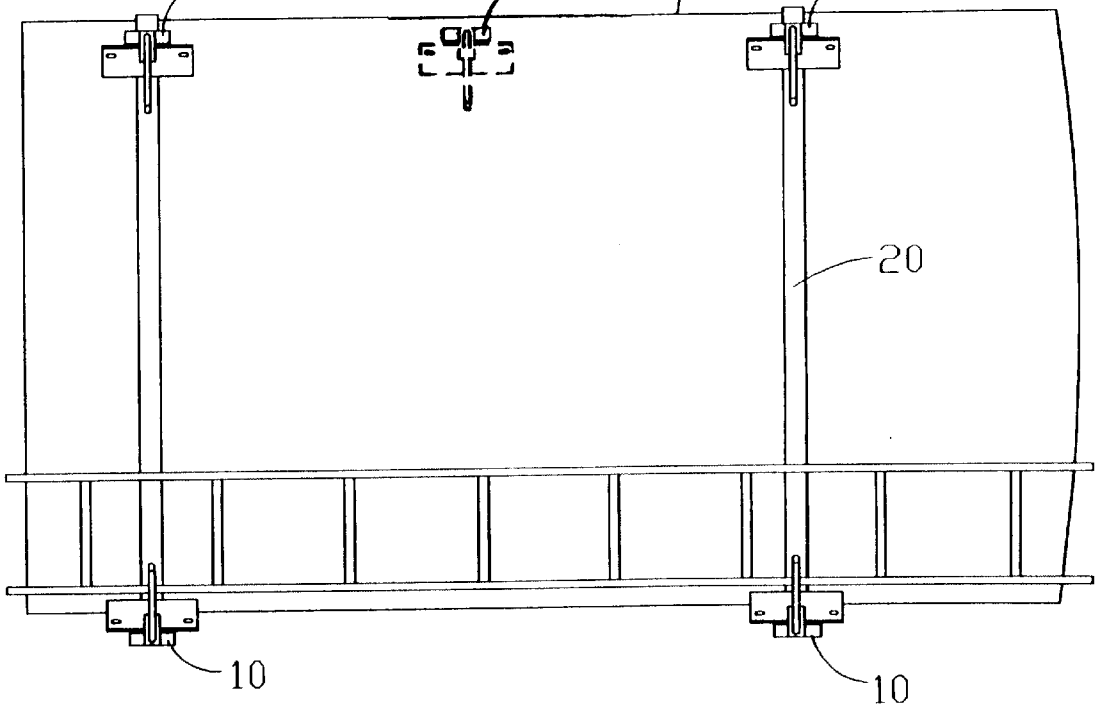
FIG. 6 is a top view of one embodiment of the present invention utilized for supporting a vehicular ladder rack.

In one embodiment of the invention, mounting plate 12 may be designed to attach to the guttering which is found on most vehicles, typically a van or panel truck, such as gutter 15 around the vehicle roof top illustrated in FIG. 6. This mounting may preferably be made in conjunction with mounting bolts at holes 18 to suitable struts of the vehicular rack which is utilized. If desired, the embodiment of FIG. 6 may utilize universal ladder lock 10 as an integral part of a vehicular rack, such as vehicular ladder rack 20. Gutter attachment lip 13 may be a two part element so as to be slidably adjustable upwardly and downwardly, if desired.

However, universal ladder lock 10 may also be attached to existing vehicular racks, such as might be provided in any position 10A as suggested in FIG. 6 which may include a middle roof position or even a side mounted ladder. If a vehicle does not have a gutter, or if it is desired to mount universal ladder lock 10 only to the frame of an existing rack, this may also be accomplished by connection to mounting plate 12 either directly or indirectly through an adaptor and/or by mounting to triangular brace 16 at mounting holes 22 or thereabout and/or by adding another suitable bracket to brace 14 at an appropriate position thereof for attachment to the rack and/or welding and/or some combination of the above, or the like. Although there are many possible ways to mount a universal ladder lock to a vehicular rack, regardless of how universal ladder lock 10 is mounted, the operation of universal ladder lock 10 will be the same or substantially the same as discussed subsequently.

Universal ladder lock 10, may preferably, but not necessarily depending on the application, include a ladder support beam, such as ladder support beam 24 mounted to brace 14, such as by welding or other connection such as receipt into various receptacles (not shown) in brace 14, which can be used to support adjustable ladder 26 thereon. If desired, ladder support beam may be open ended for receiving a cross strut that may, but not necessarily, extend over the top of the vehicle to another element, such as cross strut 20 that extends between two universal ladder locks 10 (see, for instance FIG. 6). A built in lock nut aperture (not shown) may be provided in ladder support bear 24 for securing the cross strut, such as cross strut 20, therewith such as by inserting a lock nut on one of the tubular sides of ladder support beam 24 and tightening the nut against the received strut. Other strut receptacles, perhaps pointing in different directions, can also be either attached to support beam 24 or brace 14, as desired. The present invention can be utilized for single section ladders as well as multiple section ladders and/or multiple sets of ladders. Adjustable ladder 26 is shown with two sections as indicated. Regardless of the thickness of the ladders to be carried, adjustable lock arm mechanism 28 can be utilized to lock the ladder or ladders in position.

Adjustable lock arm 28 comprises hook portion 32, which may be an inverted U-shape, or any suitable shape as desired, for trapping ladder 26 in position as discussed herein. Hook portion 32 may be coated with sound deadening material, if desired. A convenient low-cost construction can utilize right angle bends 34 and 36, or other angled bends or more gradual bends, in lock arm 28 to provide a suitable clamp or hook. Additional bends, such as for lip end 37 may also be provided, if desired. Thus, hook portion 32 is fashioned in any desired shape suitable for mating with and/or grasping and holding the ladder or ladders.

Figure 4B:
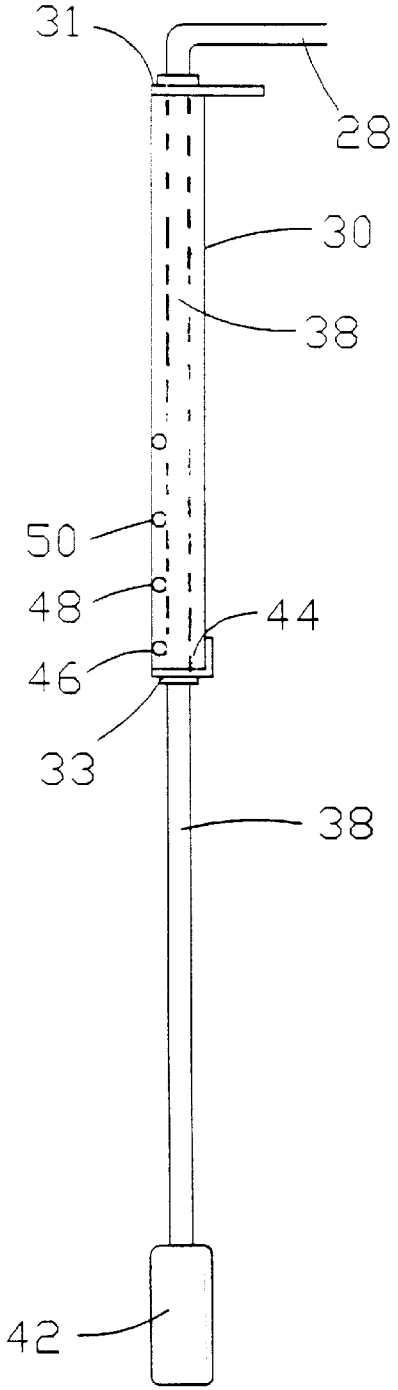
FIG. 4B is an elevational view, partially in phantom, of a locking mechanism for the present invention in the retracted position.
Figure 4A:
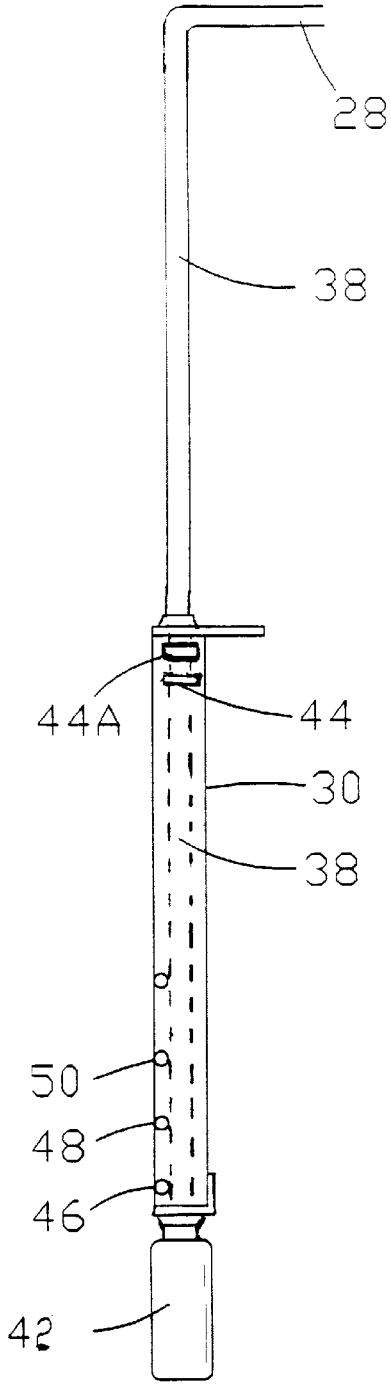
FIG. 4A is an elevational view, partially in phantom, of a locking mechanism for the present invention in the extended position.

Adjustable lock arm 28 is slidably and preferably rotatably mounted within tubular support or housing 30 (shown in greater detail in FIG. 4A and FIG. 4B). Adjustable lock arm 28 includes an extendable rod portion 38 which is movable longitudinally and rotationally. After typical mounting, the direction of longitudinal movement of rod portion 38 will generally be substantially upwardly and downwardly within tubular support 30 between an extended position (FIG. 4A) and a retracted position (FIG. 4B). In a presently preferred embodiment, upper rod guide 31 supports rod portion 38 at an upper end of housing 30 for sliding and rotational movement about a longitudinal axis of rod portion 38. Likewise, lower rod guide 33 supports rod portion 38 at a lower end of housing 30 for sliding and rotational movement. Upper rod guide 31 and lower rod guide 33 may comprise a suitable sound dampening rubber grommet, if desired, for dampening noise. Rod portion 38, as well as other portions of adjustable lock arm 28 may be made utilizing a metal rod such as, for example only, a five-eighths inch steel or stainless steel rod. Adjustable lock arm 28 may be rotated around the longitudinal axis of rod portion 38 as indicated most conveniently in FIG. 3 with respect to rotation arrow 40. Thus, adjustable lock arm 28 may be moved longitudinally along the axis of extendable rod portion 38, and may also be rotated around the longitudinal axis of extendable rod portion 38.

Although the preferred embodiment contemplates the housing 30, the rod 38 and the washer 44 each being circular in cross section, each of these components can be square, triangular, etc, if desired.

In a preferred embodiment, adjustable lock arm 28 also includes a handle grip 42 which may preferably be padded such as with plastic, rubber, or the like. Padded handle grip 42 may be conveniently utilized by an operator for longitudinally moving elongate adjustable lock arm 28 and/or for rotating adjustable lock arm 28. If padded handle grip 42 contacts the vehicle either during mounting or operation, no damage occurs because the padding is selected to be of a type that is relatively soft and leaves no marks.

Figure 5:
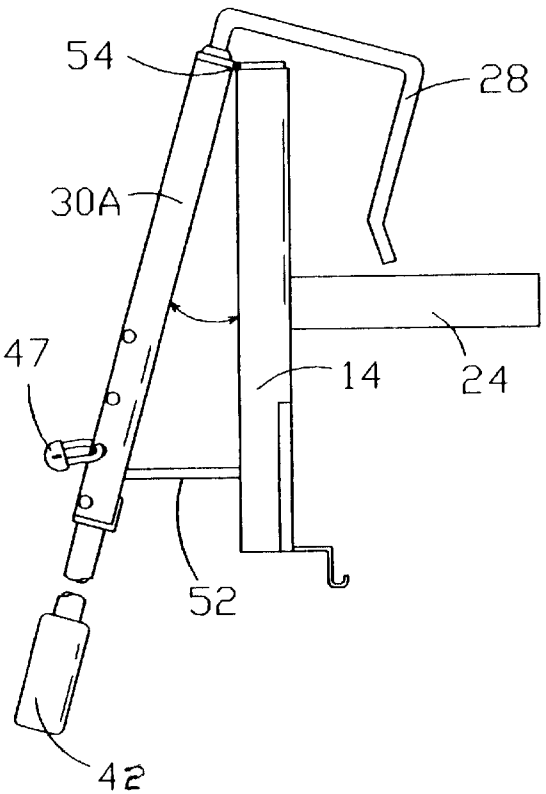
FIG. 5 is a side elevational view, of an alternate embodiment of the universal locking apparatus in accord with the present invention.

In a preferred embodiment, adjustable lock arm 28 includes lock element 44 (see FIGS. 4A and 4B), which for low cost, may simply comprise one or more suitably sized washers welded to or otherwise affixed to adjustable lock arm 28. Due to the enlarged size of lock element 44 as compared with the diameter of rod section 38, lock element 44 is prevented from moving past either upper rod guide 31 or lower rod guide 33. However lock element 44 is free to move within housing 30 with rod section 38 prior to locking. If a lock, such as padlock 47 in FIG. 5, is provided within a lock holder mounting, then lock element 44 cannot move past the lock and thus adjustable lock arm is locked in position. Lock holder mountings are conveniently formed by holes 46, 48, and 50 but can also be otherwise shaped or constructed to receive a locking pin, or preferably a padlock such as padlock 47. Thus, a standard padlock may be inserted into one of locking holes 46, 48, 50, or other holes positioned as desired along housing 30 to prevent extension of rod 38 by preventing lock element 44 moving longitudinally upwardly, as per the orientation in the figures, past the lock. If desired, two lock elements, such as lock element 44 and 44A could be utilized to thereby prevent both upwardly or downwardly movement of rod 38, assuming 44 and 44A were positioned on either side of the locking hole when the lock is inserted therein. In any case, once a lock is inserted into a lock hole, the adjustable lock arm cannot be moved upwardly to release the ladder. Thus, adjustable lock arm 28 may be rotated out of the way of ladders to be installed or removed from the rack, and then pushed over and/or pulled down for locking and/or releasing the ladder from the vehicular rack. FIG. 2 provides an example of adjustable lock arm 28 in the locked position, which is also typically the retracted position, whereby ladder 26 is secured in place. Thus, a lock inserted into the desired lock hole prevents element 44 from upward, extending, or unlocking movement of elongate lock arm 28. If a lock is not desired, then a spring loaded clamp, locking pin, or the like may be quickly inserted in one of the lock holes to latch adjustable lock arm 28 in position.

FIG. 5 shows an alternate embodiment of the present invention whereby tubular support 30A is angled with respect to strut 14. Brace 52 may be used to affix support 30A at a desired angle with respect to strut. This configuration may be utilized when the upper portion of the panel truck, van, or the like, is angled with respect to the vertical. Although brace 52 may be a solid brace, an adjustable brace might also be utilized whereby the angle can be adjusted to match the angle of the upper portion of the vehicle. If brace 52 is adjustable, then upper connection 54 is preferably hinged so as to be pivotal. As discussed in the previous embodiment, padlock 47 may be inserted into the lock receptacles or holes 46, 48, or 50 for locking elongate lock arm 28.

FIG. 6 shows a typical vehicular rack system and various possibilities for mounting universal ladder lock 10 at various positions. It may be desired simply to have one universal lock 10 on either side of rack 20 such as at 10A. Of course, universal ladder lock 10 could also be utilized at various positions, if desired, although one lock is more than adequate for securing the ladder in position.

In one example of typical operation, handle 42 may be used to rotate lock arm 28 out of the way of ladder support 24 so that a ladder, such as ladder 26 may be lying thereon. Handle 42 may then be utilized to extend lock arm 28 upwardly until there is clearance between tip 37 and the top of ladder 26. Handle 42 may then be utilized to retract lock arm 28 until the hook portion secures ladder 26 to ladder support 24. A lock may then be positioned in the appropriate lock hole to prevent lock arm 28 from moving upwardly to lock the ladder to the vehicular rack. To release the ladder, the lock is removed and the hook portion raised up, rotated around, and lowered out of the way whereby the ladder is easily moveable.

Various embodiments may also be utilized. For instance, means for rotatably locking lock arm 28 could also be provided, if desired. For instance, one or more splines may be provided or rod portion 38 adjacent lock element 44 with one or more slots mounted within cylinder 30 adjacent or near the lock holes such that when lock arm 28 is placed in the retracted position, rotation is prevented. Putting a suitable hole or receptacle within strut 24 for receiving tip 37 might accomplish the same effect of rotatably locking lock arm 28 in position, if desired. In another embodiment, lock arm 28 could have extended portion 38 curved so long as housing 30 was also curved to permit sliding movement thereof and which may or may not prevent rotation thereof. Other types of control handles could be attached to locking arm 28 for operation thereof. Lock housing 30 might be made integral with strut 14 such that upper and lower rod guides are mounted to strut 14 with lock hole supports mounted to strut 14 for supporting the lock. Adjustable locking arm 28 could be square or rectangular in cross-section rather than round, and upper rod guide 31 and lower rod guide 33 could also be square or rectangular so that, if desired, rotation of adjustable locking arm 28 is prevented.

In general, it will be understood that such terms as "up," "down," "vertical," and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size of the components may be greatly different from that shown and still be in accord with the spirit of the invention.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various elements may be made without departing from the spirit of the invention.

What is claimed is:

1. A ladder lock for locking a ladder to a vehicular rack mounted entirely on the exterior of a vehicle, said ladder lock when in use being completely exterior to the vehicle, comprising:

a mounting frame securable to said vehicular rack;

a lock housing secured to said mounting frame, said lock housing supporting an upper guide and a lower guide;

an elongate lock arm slidably mounted within said upper guide and said lower guide for sliding movement between a locked position and an unlocked position along an axis of said elongate lock arm between said upper guide and said lower guide and for rotation of said elongate lock arm about said axis;

at least one lock element mounted to said elongate lock arm for movement therewith within said lock housing, said at least one lock element being sized for stopping engagement with said upper guide thereby limiting said sliding movement of said elongate lock arm in one direction, said at least one lock element being sized for stopping engagement with said lower guide thereby limiting said sliding movement of said elongate lock arm in an opposite direction; and at least one lock receptacle formed on said lock housing, said at least one lock receptacle being operable for receiving a locking member to thereby lock said ladder to said vehicular rack.

2. The ladder lock of claim 1, further comprising:

a hook at one end of said elongate lock arm.

3. The ladder lock of claim 2, wherein said hook is U-shaped and sized to fit over said ladder.

4. The ladder lock of claim 2, further comprising:

a handle at an opposite end of said elongate lock arm from said hook.

5. The ladder lock of claim 4, wherein said handle further comprises non-metallic material.

6. The ladder lock of claim 1, wherein said elongate lock arm further comprises a rod with a circular cross-section.

7. The ladder lock of claim 1, further comprising:

a brace between said mounting frame and said lock housing such that said lock housing is mounted at an angle with respect to said mounting frame.

8. The ladder lock of claim 7, wherein said brace is adjustable for adjusting said angle.

9. The ladder lock of claim 8, further comprising a U-shaped end section at one end of said lock arm.

10. The ladder lock of claim 8, further comprising:

a handle at one end of said lock arm.

11. The ladder lock of claim 10, further comprising:

a support strut affixed to said mounting frame for supporting said ladder.

12. A ladder lock for locking a ladder to a vehicular rack mounted entirely on the exterior of a vehicle, said ladder lock when in use being completely exterior to the vehicle comprising:

a mounting frame securable to said vehicular rack;

an upper guide and a lower guide secured with respect to said mounting frame;

a lock arm slidably mounted within said upper guide and said lower guide for sliding movement between a locked position and an unlocked position along an axis of said lock arm between said upper guide and said lower guide;

at least one lock element mounted to said elongate lock arm for movement therewith, said at least one lock element being sized for stopping engagement with said upper guide thereby limiting said sliding movement of said lock arm in one direction, said at least one lock element being sized for stopping engagement with said lower guide thereby limiting said sliding movement of said lock arm in an opposite direction; and at least one receptacle affixed with respect to said mounting frame, said at least one receptacle being operable for receiving a lock member to thereby limit said sliding movement of said at least one lock element and said lock arm to lock said ladder to said vehicular rack.

13. The ladder lock of claim 12, wherein said lock arm is mounted to said upper guide and lower guide for rotation of said lock arm about said axis.

14. The ladder lock of claim 12, wherein said lock member comprises a padlock.

15. A method for making a ladder lock for locking a ladder to a vehicular rack mounted entirely on the exterior of a vehicle, said ladder lock when in use being completely exterior to the vehicle, said method comprising:

providing a mounting for securing said ladder lock with respect to said vehicular rack;

slidably mounting a rod section within a first rod guide and a second rod guide such that said rod section is longitudinally and rotatably moveable within said first rod guide and said second rod guide;

providing a hook at one end of said rod section for looping around a portion of a ladder;

securing at least one stop member to said rod section to limit travel of said at least one stop member between said first rod guide and said second rod guide;

providing at least one lock member holder adjacent said rod section such that when a lock member is positioned within said at least one lock member holder that said stop member prevents longitudinal movement of said rod section to thereby lock said ladder to said vehicular rack.

16. The method of claim 15, further comprising:

affixing a tubular housing to said mounting such that said rod section is moveable within said tubular housing.

17. The method of claim 16, further comprising:

affixing said first rod guide and said second rod guide to said tubular housing.

18. The method of claim 16, further comprising:

forming said one or more lock member holders within said tubular housing.

19. The method of claim 18, further comprising:

fashioning a handle on one end of said rod section.

* * * * *